United States Patent [19]

Kittscher

[11] Patent Number: 4,773,560

[45] Date of Patent: Sep. 27, 1988

[54] MEASURING CUP CLOSURE AND METHOD FOR FITTING THE CLOSURE

[75] Inventor: Peter Kittscher, Kaarst, Fed. Rep. of Germany

[73] Assignee: Henkel Kommanditgesellschaft auf Aktien, Duesseldorf, Fed. Rep. of Germany

[21] Appl. No.: 80,117

[22] Filed: Jul. 31, 1987

[30] Foreign Application Priority Data

Aug. 1, 1986 [DE] Fed. Rep. of Germany ..... 3626154

[51] Int. Cl.[4] ..... B67D 1/16; B65B 7/28

[52] U.S. Cl. ..... 222/109; 222/153; 215/228; 53/490

[58] Field of Search ..... 53/128, 317, 331.5, 53/420, 485, 490; 215/228, 330; 493/87; 222/108, 109, 111, 153, 424, 481, 482, 544–545, 548, 551, 562, 566

[56] References Cited

U.S. PATENT DOCUMENTS

| | | | |
|---|---|---|---|
| 2,673,663 | 3/1954 | Calabro | 222/568 X |
| 2,751,131 | 6/1956 | Nyden | 222/562 |
| 3,124,273 | 3/1964 | Remington et al. | 222/562 X |
| 3,221,952 | 12/1965 | De See | 222/545 X |
| 3,318,496 | 5/1967 | Ayotte et al. | 222/546 |
| 3,833,150 | 9/1974 | Visser-Patings | 222/109 |
| 4,128,189 | 12/1978 | Baxter | 222/109 |
| 4,427,138 | 1/1984 | Heinlein | 222/546 |
| 4,550,862 | 11/1985 | Barker et al. | 222/109 |
| 4,607,762 | 8/1986 | Zulauf et al. | 222/48 |

FOREIGN PATENT DOCUMENTS

| | | |
|---|---|---|
| 3207223 | 9/1983 | Fed. Rep. of Germany . |
| 50-46273 | 10/1976 | Japan . |

*Primary Examiner*—Michael S. Huppert

*Attorney, Agent, or Firm*—Ernest G. Szoke; Henry E. Millson, Jr.; Real J. Grandmaison

[57] ABSTRACT

A measuring cup closure for a container opening having a screwthread formed on its outside surface. The closure has a spout part which is placeable in the container opening, a pouring spout, and an outer ring formed integrally around the base of the spout part. The outer ring is adapted for surrounding the rim of the container opening from the inside to the outside of the container.

The closure includes a measuring cup which is adapted to be screwed onto the container opening over the spout part wherein the aforementioned outer ring of the spout part has a screwthread for screwing the measuring cup thereto. The measuring cup is integrally formed with an encircling ring having an internal screwthread corresponding to the screwthread of the outer ring of the spout part and the screwthread of the container opening.

17 Claims, 2 Drawing Sheets

1
6
12
18
20
7
9
11
13
4
5
10
16
2
14
17
8
3
19
15

MEASURING CUP CLOSURE AND METHOD FOR FITTING THE CLOSURE

BACKGROUND OF THE INVENTION

1. Field of the Invention

This invention relates to a measuring cup closure for a container opening, more particularly, for a bottle neck formed on its outside with a screwthread, and to a method for fitting the measuring cup closure thereto.

2. Discussion of Related Art

A closure of the type herein is described in European Patent Application 109,704. In said application, the spout part of the closure incorporating the pouring spout is screwed as an intermediate part onto the screwthread surrounding the container opening. In addition, the spout part is formed with an internal screwthread into which the dispensing cup is designed to be screwed through a screwthread formed on its outer surface. Accordingly, the spout part has to be stable enough to absorb the torques generated during the tightening and loosening and adjustment of the spout part and the measuring and dispensing cup. The outlay for material which this involves both for the container and the spout is considerable.

Another measuring cup closure is described in German Patent application 32 07 223. This screw closure is designed for a container opening, more especially a bottle neck, with an internal screwthread and a measuring cup situated above the container opening in the closed position. To assure that the neck and shoulder of the container are not wetted with residual product in the measuring cup when the measuring cup is screwed onto the container opening, the measuring cup is extended at its open end by a product draining ring which projects into the container opening in the closed position, the screwthread being disposed on the outside of the measuring cup in the form of an encircling ring. However, this known measuring cup closure does not have a pouring spout so that, after the product has been poured out from the container, there is always a danger of at least some drops of the product running down the neck of the container.

An object of this invention is to minimize the cost for material required for the provision of a stable measuring cup closure system and to overcome the afore-mentioned disadvantages of the prior art.

DESCRIPTION OF THE INVENTION

Other than in the operating examples, or where otherwise indicated, all numbers expressing quantities of ingredients or reaction conditions used herein are to be understood as modified in all instances by the term "about".

The measuring cup closure for a container opening in accordance with this invention, particularly for a bottle neck having a screwthread formed on its outside surface, comprises (a) a spout part placed in a container opening, the spout part being adapted for draining into the interior of the container, said spout part comprising a pouring spout and an outer ring which is formed integrally around the base of the pouring spout, the outer ring surrounding the pouring spout at a distance therefrom, and which is adapted to surround the rim of the container opening from the inside to the outside of said container; and (b) A measuring cup which is adapted to be screwed into the container opening over said spout part wherein the rim of said measuring cup, in the closed position, extends into the region between said pouring spout and its outer ring to permit drainage into the interior of the container via an outlet in said outer ring.

The invention also relates to method for fitting the measuring cup closure. The improvement which the invention provides for the measuring cup closure herein is characterized in that the outer ring of the spout part which surrounds the rim of the container opening from inside to outside has a periphery with a thread line extending the screwthread of the container opening and in that the outer surface of the measuring cup is integrally formed with an encircling ring comprising an internal screwthread which fits onto the screwthread of the container opening extended by the periphery of the spout part.

The effect achieved by the invention is that, solely by means of that part of the outer ring which surrounds the container opening, the spout part can be inserted on the lines of a washer between the end face of the container opening and the associated clamping surface of the encircling screwthreaded inner ring of the measuring cup. A washer such as this is capable of transmitting considerable forces without appreciable material requirement. Accordingly, the spout part according to the invention may be designed solely with its actual function in mind, namely to act as a pouring spout. The spout part does not absorb any forces transmitted from the measuring cup to the container (or vice versa), instead it is merely oriented as required inside the container opening, preferably projecting into the interior of the container.

Another advantage of the closure according to the invention is that, at its periphery, the spout part comprises an extension of the screwthread of the container opening so that the spout part may be screwed into the internal thread of the measuring cup before the closure is fitted onto the container opening. After this pre-fitting step, the closure may be screwed onto the container on a standard container-filling line without any need for additional machinery.

As already mentioned, the spout part, when it is being screwed on, is oriented by the periphery of the outer ring of the spout part which extends the screwthread of the container opening. According to a further aspect of the invention, the spout part is additionally oriented by the fact that the dividing line between the mouth of the container opening and the pouring spout extends along the screwthread of the container opening and by the fact that a thread gap at the outer end of the screwthread forms a stop for aligning the spout part. Accordingly, separate mouldings, for example ratchet-like mouldings, are not required for the mutual alignment of the various components because already present forms and functions are used for clamping, alignment and orientation.

To prevent the spout part from jamming in the measuring cup, the rim of the container opening comprises a cam directed oppositely to a thread gap stop, against which a sharp-edged recess in the spout part strikes during turning of the cup closure in the unscrewing direction. When the closure is turned in the screwing direction, the cam travels over a ramp without major effort.

In addition, the thread interval between the spout part and the container is selected so that, when the closure is tightened, pressure is applied between the thread of the container and the sealing surface of the pouring spout, i.e. the pitch in the transition zone is 0.2 to 1 mm greater than over the rest of the thread. In addition, the angles of the thread flanks of the measuring cup and the spout part differ from one another by about 5° to minimize the friction forces.

When the spout part projects into the container, as is preferably the case, a slot extending substantially parallel to the axis of the container opening is provided in the outer ring of the spout part opposite the pouring side of the spout. The remaining product can be poured out through this slot when the container is held upside-down.

Providing the mouth of the container is suitably shaped, the measuring cup may of course also be used without the spout part as a closure for the container.

The invention is described in more detail in the following with reference to the accompanying diagrammatic drawing of one embodiment thereof.

DESCRIPTION OF THE DRAWINGS

Figure 1:
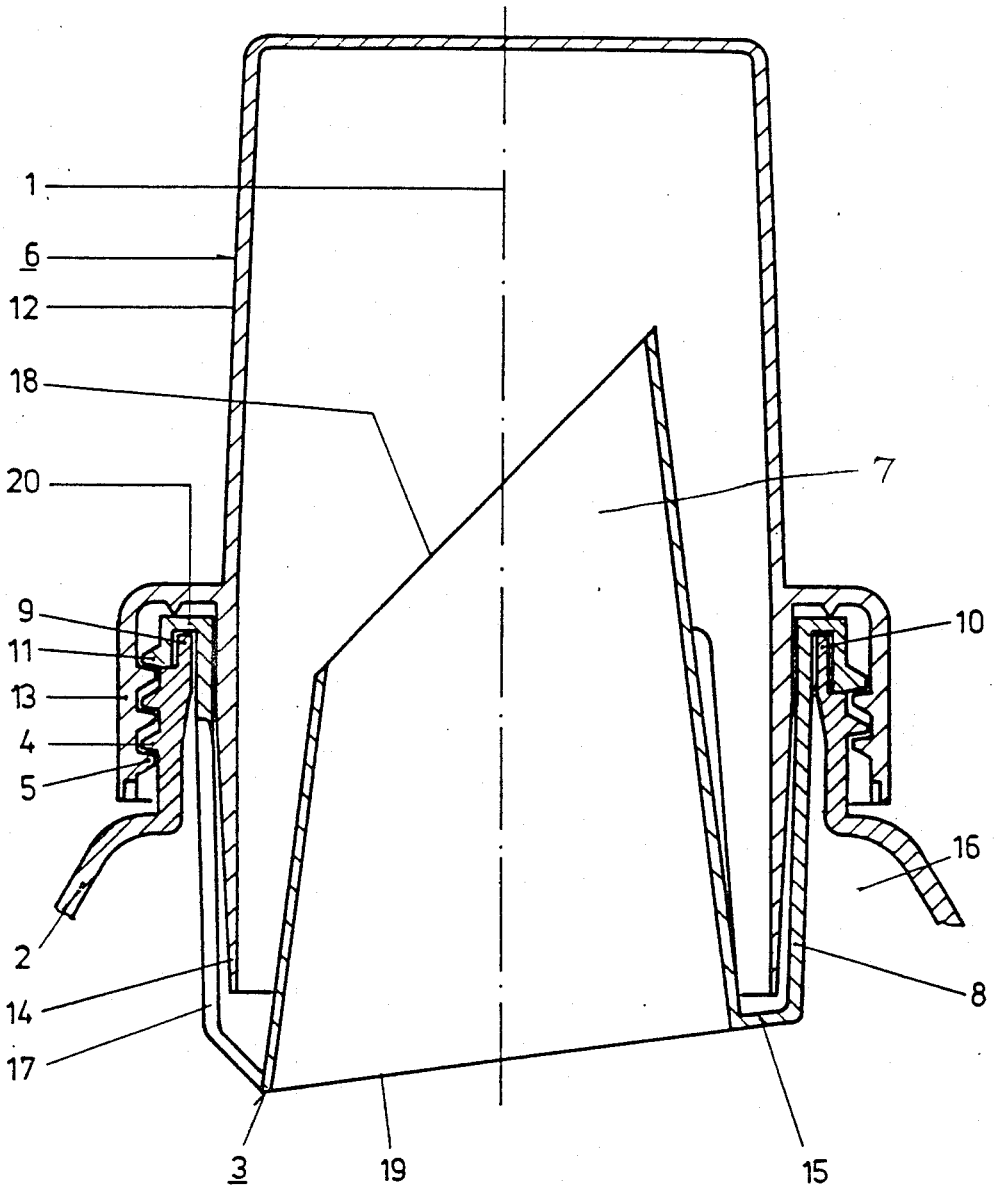
FIG. 1 is a sectional view of the measuring cup constructed in accordance with a preferred embodiment of the invention.

The measuring cup closure shown in section in the accompanying FIG. 1, positioned parallel to the axis 1 of a container opening 2, consists essentially of a spout part 3 designed to be inserted into the container opening 2 and a measuring cup 6 designed to be placed over the spout part 3 and to be screwed onto an outer screwthread 4 through an internal thread 5. The actual pouring spout 7, which is designed to be fitted in the container opening 2 and which, when necessary, drains into the interior of the container, comprises an outer ring 8 which is formed integrally around its base, i.e. at its end facing the interior of the container, and which surrounds the pouring spout 7 at a distance, surrounding the rim 9 of the container opening from inside to outside.

The outer ring 8 which surrounds the rim 9 of the container opening 2 from the inside to the outside of the container has a periphery 10 extending the screwthread 4 of the container opening 2 with at least one thread line 11. In practice, an encircling ring 13 integrally formed around the outer surface 12 of the dispensing cup 6 is screwed onto the screwthread 4 thus extended through its internal thread 5 which fits onto the screwthread 4 of the container opening 2 extended by the periphery 10 of the spout part.

The measuring cup 6 designed to be screwed onto the container opening 2 over the pouring spout 7 has a draining edge or rim 14 which, in the closed position, is directed into the region between the spout 7 and its outer ring 8. The draining edge 14 is preferably in the form of a substantially cylindrical or slightly spherical extension of the measuring cup 6. To ensure that product draining from the measuring cup 6 after it has been used is able to flow back into the interior of the container, an outlet preferably in the form of a slot 17 extending substantially parallel to the axis 1 of the container opening 2 is provided in the outer ring 8 at the base 15 of the outer ring or at the lowest point of the region 16 between the pouring spout 7 and its outer ring 8.

Where it is of circular or oval cross-section, as seen perpendicularly to the plane of the drawing, the pouring spout 7 may be provided with an opening 18 in the plane of the base 15 of the outer ring extending obliquely of the axis 1, and with an opening 19 opposite the base 15 so that, when the container adjoining the opening 2 is tilted, product is able to flow out through the openings 18 and 19 of the pouring spout 7.

The outer ring 8 of the spout part 3 is best clamped or press-fitted onto the rim 9 of the container with its outer rim 20 surrounding the rim of the container opening 2 in such a way that, after the spout part 3 has been fixed, it almost becomes a part of the container opening 2 through force or form locking.

Since the spout part 3 extends to the outside solely through the narrow periphery 10 and the thread line 11 as part of the screwthread 4, but since the measuring cup 6 covers the screwthread and hence the spout part 3 completely through the encircling ring 13, the spout part 3 cannot be seen from the outside.

Figure 2:
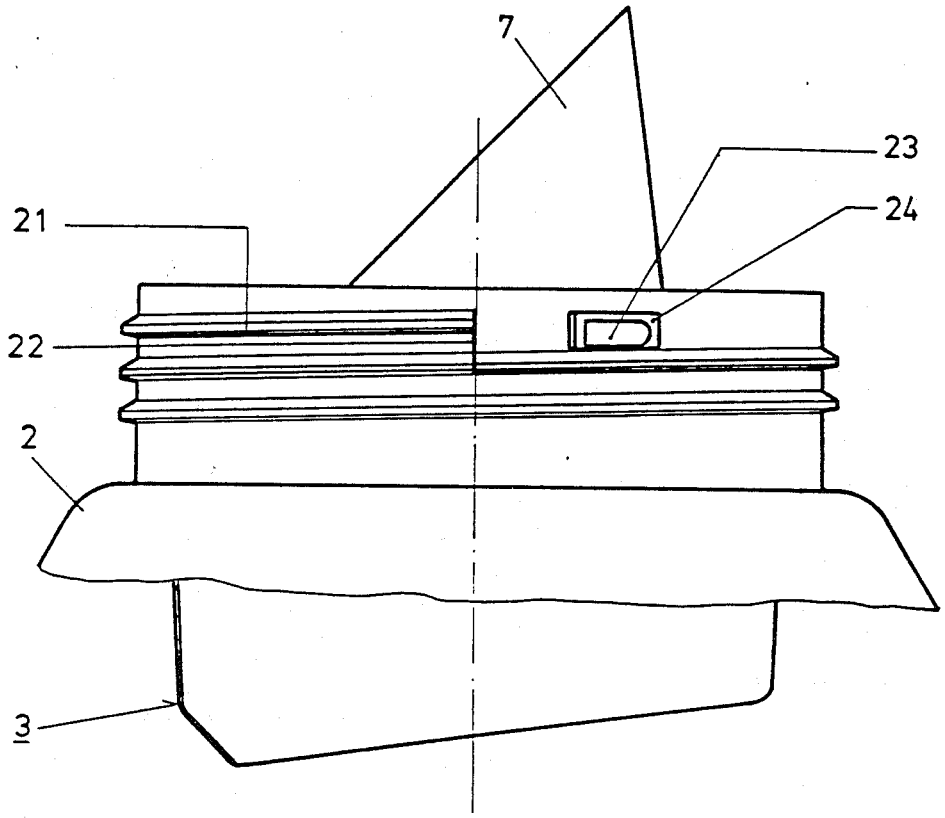
FIG. 2 is a fragmentary, partial cross-sectional view of the invention with the measuring cup removed and the container cam exposed.

In addition, as shown in FIG. 2, where the dividing line 21 between the container opening 2 and the pouring spout 7 extends along the screwthread 4 of the container opening 2, a thread gap 22 at the outer end of the screwthread 4 forms a stop for alignment of the spout part 3. In addition, a cam 23 directed oppositely to the screwthread 4 is provided on the rim 9 of the container opening 2 to prevent the spout part 3 from being unintentionally turned back during unscrewing of the measuring cup 6. The periphery 10 of the spout part 3 has a recess 24 corresponding to the cam 23. The thread gap 22 forming the alignment stop and the cam 23 forming the safety stop are designed in such a way that the spout part runs into a "pocket" to prevent overriding of the stops under severe screwing forces.

For fitting together, the spout part 3 merely has to be screwed with its thread line 11 into the internal screwthread 5 of the encircling ring 13 of the measuring cup 6. The measuring cup closure thus prepared is suitable for screwing as a unit onto the outer thread 4 of the container opening 2, more especially in the normal container-filling line.

I claim:

1. A measuring cup closure for a container opening have a screwthread formed on its outside surface comprising:

a. a spout part placed in said container opening, said spout part being adapted for draining into the interior of said container, said spout part comprising a pouring spout and an outer ring which is formed integrally around the base of said spout, said outer ring surrounding said spout at a distance therefrom, said outer ring being adapted for surrounding the rim of said container opening from the inside to the outside of said container; and b. a measuring cup which is adapted to be screwed onto said container opening over said spout part wherein said outer ring of said spout part has a screwthread for screwing said measuring cup thereto, said measuring cup having a rim which in the closed position extends into the region between said pouring spout and said outer ring to permit drainage into the interior of said container via an outlet in said outer ring, said outlet being in the form of a slot extending substantially parallel to the axis of said container opening and located at the base of said outer ring, said outer ring further being characterized as having a thread line which extends the screwthread of said container opening, and wherein said measuring cup is integrally formed with an encircling ring comprising an internal screwthread for fitting onto the screwthread of said container opening.

2. A measuring cup closure as in claim 1 wherein said outer ring of said spout part forms an extension of the screwthread of said container opening to enable said spout part to be screwed into the internal thread of said measuring cup before said closure is fitted onto said container opening.

3. A measuring cup closure as in claim 2 wherein said closure is screwed onto said container opening.

4. A measuring cup closure as in claim 3 wherein said spout part when screwed into said measuring cup is oriented by the periphery of said outer ring of said spout part which extends the screwthread of said container opening.

5. A measuring cup closure as in claim 1 wherein the dividing line between the mouth of said container opening and said pouring spout extends along the screwthread of said container opening, and a thread gap at the outer end of said screwthread forms a stop for aligning said spout part.

6. A measuring cup closure as in claim 1 wherein a cam directed oppositely to said screwthread of said container opening is associated with the rim of said container opening to prevent said spout part from being unintentionally turned back on said rim, and said spout part has a recess corresponding to said cam.

7. A measuring cup closure as in claim 1 wherein said outlet in said outer ring is located in the region between said pouring spout and said outer ring, and is in the form of a slot in said outer ring extending substantially parallel to the axis of said container opening.

8. A measuring cup closure as in claim 1 wherein said outer ring of said spout part is press-fitted onto said rim of said container opening, and the outer rim of said outer ring surrounds said rim of said container opening.

9. A measuring cup closure as in claim 1 wherein said spout part is completely covered by the screwed-on measuring cup.

10. A measuring cup closure as in claim 1 wherein said measuring cup, in the closed position, projects with its open end into the region between said pouring spout and said outer ring.

11. A measuring cup closure as in claim 10 wherein said measuring cup has a draining edge.

12. A measuring cup closure as in claim 11 wherein said draining edge is in the form of a substantially cylindrical extension of said measuring cup.

13. A measuring cup closure as in claim 1 wherein said pouring spout has a circular cross-section and is provided with an opening in the plane of the base of said outer ring extending obliquely of the axis of said container opening.

14. A measuring cup closure as in claim 13 wherein said pouring spout also has an opening located opposite said base of said outer ring.

15. A process for attaching a measuring cup closure to a container opening having a screwthread formed on its outside surface comprising placing in said container opening a spout part having a pouring spout and an outer ring which is formed integrally around the base of said spout part and surrounds said spout part at a distance therefrom, said outer ring being adapted for surrounding the rim of said container opening from the inside to the outside of said container and having a screwthread at its periphery forming an extension of the screwthread of said container opening to enable said spout part to be screwed into an internal screwthread of a measuring cup before placing said closure into said container opening, and screwing to said spout part and said container opening a measuring cup closure having an integrally formed encircling ring comprising an internal screwthread adapted for fitting onto the screwthread of said container opening and the screwthread of said outer ring of said spout part, said spout part and said measuring cup closure being screwed together before placing said spout part in said container opening.

16. A process as in claim 15 including screwing said measuring cup closure to the screwthread of said container opening.

17. A process as in claim 15 wherein said spout part is adapted for draining into the interior of the container via an outlet in its outer ring.

* * * * *